US005417846A

United States Patent [19]

Renard

[11] Patent Number: 5,417,846

[45] Date of Patent: May 23, 1995

[54] HYDROTREATMENT METHOD FOR A PETROLEUM RESIDUE OR HEAVY OIL WITH A VIEW TO REFINING THEM AND CONVERTING THEM TO LIGHTER FRACTIONS

[75] Inventor: Pierre Renard, Saint Nom La Breteche, France

[73] Assignee: Institut Francais du Petrole, Rueil-Malmaison, France

[21] Appl. No.: 46,506

[22] Filed: Apr. 14, 1993

Related U.S. Application Data

[63] Continuation of Ser. No. 677,179, Mar. 29, 1991, abandoned.

[30] Foreign Application Priority Data

Mar. 29, 1990 [FR] France ..... 90 04153

[51] Int. Cl.[6] ..... C10G 23/02

[52] U.S. Cl. ..... 208/210; 208/251 H; 208/211; 208/212

[58] Field of Search ..... 208/210, 211, 89, 212, 208/251 H

[56] References Cited

U.S. PATENT DOCUMENTS

| | | | |
|---|---|---|---|
| 3,716,479 | 2/1973 | Weisy et al. | 208/210 |
| 3,809,644 | 5/1974 | Johnson et al. | 208/210 |
| 3,900,390 | 8/1975 | Adams et al. | 208/210 |
| 3,901,792 | 8/1975 | Walk et al. | 208/210 |
| 3,968,026 | 7/1976 | Frayer et al. | 208/210 |
| 4,053,391 | 10/1977 | Paraskos et al. | 208/210 |
| 4,054,508 | 10/1977 | Milslun | 208/210 |
| 4,118,310 | 10/1978 | Frayer et al. | 208/210 |
| 4,925,554 | 5/1990 | Sato et al. | 208/210 |

FOREIGN PATENT DOCUMENTS

| | | |
|---|---|---|
| 0113297 | 7/1984 | European Pat. Off. . |
| 2124252 | 7/1983 | United Kingdom . |

*Primary Examiner*—Helane Myers

*Attorney, Agent, or Firm*—Millen, White, Zelano, & Branigan

[57] ABSTRACT

The invention concerns a hydro treatment method in at least two stages, for a heavy hydrocarbon fraction containing asphaltenes, sulphur impurities and metallic impurities, wherein:

a) in at least one first stage described as hydrodemetallization, the hydrocarbon charge and hydrogen are passed over a hydrodemetallization catalyst, b) in at least one subsequent stage described as hydrodesulphurization, the product of stage a) and hydrogen are passed over a hydrodesulphurization catalyst.

The invention, in which the hydrodemetallization stage comprises one or more zones each containing hydrodemetallization catalyst operating in a fixed bed, is characterised in that this zone or these zones are preceded by two protective zones arranged in parallel, each containing a fixed bed of a hydrodemetallization catalyst, the two protective zones operating alternately.

16 Claims, 2 Drawing Sheets

HYDROTREATMENT METHOD FOR A PETROLEUM RESIDUE OR HEAVY OIL WITH A VIEW TO REFINING THEM AND CONVERTING THEM TO LIGHTER FRACTIONS

This is a continuation of U.S. Ser. No. 07/677,179, filed Mar. 29, 1991, now abandoned.

BACKGROUND OF THE INVENTION

The invention concerns refining and conversion of heavy liquid hydrocarbon fractions containing inter alia asphaltenes and sulphur and metallic impurities, such as atmospheric residues, vacuum residues, deasphalted oils, pitches, asphalts mixed with an aromatic distillate, coal hydrogenates or heavy oils from any source and particularly from asphaltic sands or oil shales.

These charges which can be treated according to the invention generally contain at least 100 ppm by weight of metals (nickel and/or vanadium), at least 1% by weight of sulphur and at least 2% by weight of asphaltenes.

The object of the catalytic hydrotreatment of these charges is both to refine, i.e. substantially reduce, their content of asphaltenes, metals, sulphur and other impurities, while at the same time improving the hydrogen to carbon ratio (H/C) and converting them more or less partially to lighter cuts. The various effluents thus obtained can act as bases for the production of high quality fuel, gas oil and petrol, or charges for other units such as residue cracking.

The problem posed by the catalytic hydrotreatment of these charges stems from the fact that the impurities are deposited bit by bit on the catalyst in the form of metals and coke, and tend to deactivate and rapidly clog the catalytic system, necessitating a stoppage for its replacement.

Methods of hydrotreatment for this type of charge must therefore be designed to allow the longest possible operating cycle without stopping the unit. The objective is to achieve a one year operating cycle at the minimum, or a minimum of eleven months' continuous operation plus a maximum of one month's stoppage to replace the whole catalytic system.

PRESENT STATE OF THE ART

There are various existing treatments for this type of charge. They have so far been carried out:

- either in methods with fixed beds of catalyst, for example, the HYVAHL-E process of Institut Francais du Pétrole;
- or in methods comprising at least one reactor allowing for quasi continuous replacement of catalyst, such as the HYVAHL-M fluidized bed method of IFP.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

a) FIXED BED METHODS

Figure 1:
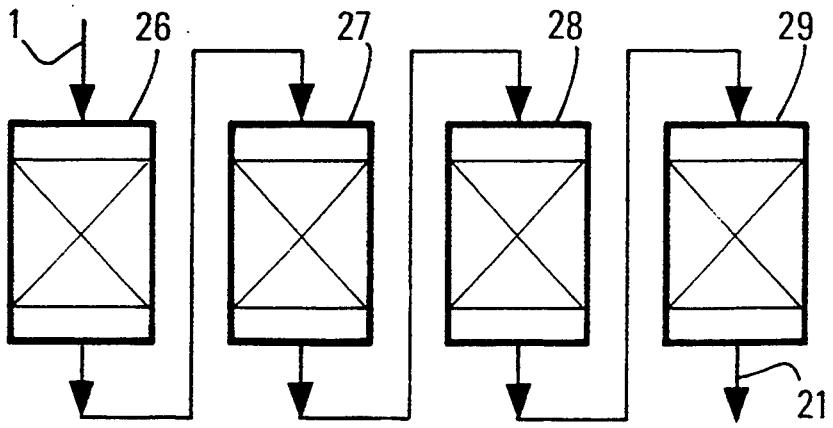
FIGS. 1–4 are flowsheets or prior art systems for hydrotreating the above-described charges.

This method is an improvement to the methods with fixed beds of catalyst. In such methods (see FIG. 1), the charge arriving along line 1 circulates through a plurality of fixed bed reactors arranged in series, the first reactor or reactors 26 or 27 being used chiefly for hydrodemetallization of the charge (so-called HDM stage) and a hydrodesulphurization part, the last reactor or reactors 28 or 29 being used for deep refining and particularly hydrodesulphurization of the charge (so-called HDS stage). The effluents are drawn off from the last HDS reactor 29 through the pipe 21.

Such methods most frequently use specific catalysts adapted to each stage, under mean operating conditions of about 150 to 200 bars pressure and about 370° to 420° C. temperature.

For the HDM stage the ideal catalyst must be capable of treating charges rich in asphaltenes, while at the same time having a high demetallizing power associated with a high capacity for retaining metals and great resistance to coking. Such a catalyst has been developed on a particular macroporous carrier (with a "sea urchin" structure) which gives it the precise properties required at this stage (Patents EP-B-113297 and EP-B-113284):

- Demetallization rate of at least 80 to 90% at the HDM stage;
- Metal retaining capacity of over 60% relative to the weight of new catalyst, enabling longer operating cycles to be obtained;
- Great resistance to coking even at temperatures over 400° C., thus helping to lengthen the cycle, which is often limited by an increase in the pressure drop and loss of activity due to coke production, and enabling the essential part of the heat conversion to be obtained at this stage.

For the HDS stage the ideal catalyst must have strong hydrogenating power so as to carry out deep refining of the products: desulphurization, continued demetallization, lowering of the Conradson carbon and the asphaltene content. Applicants have developed such a catalyst (Patents EP-B-113297 and EP-B-113284) which is particularly well adapted to treating this type of charge.

The disadvantage of this type of catalyst with high hydrogenating power is that it is deactivated rapidly in the presence of metals or coke. Therefore if an appropriate HDM catalyst, capable of functioning at relatively high temperature to carry out the essential part of the conversion and demetallization, is associated with an appropriate HDS catalyst—which, being protected from metals and other impurities by the HDM catalyst, can be operated at a relatively low temperature, thereby encouraging deep hydrogenation and limitation of coking—the global refining performance finally obtained is better than that obtained with a single catalytic system and better than that obtained with a similar HDM/HDS arrangement using an increasing temperature profile, which leads to rapid coking of the HDS catalyst.

The importance of fixed bed methods is that a good refining performance is obtained due to the great catalytic effectiveness of fixed beds. On the other hand, when the charge has more than a certain metal content (e.g. 100 to 150 ppm), in spite of using the best catalytic systems, the performance and above all the operating time of the process is found to become inadequate: the reactors (particularly the first HDM reactor) rapidly become charged with metals and thus deactivated. Temperatures are increased to compensate for the deactivation, thus encouraging coke formation and an increase in the pressure drop. Moreover the first catalytic bed is known to be liable to clog fairly rapidly due to the asphaltenes and sediments contained in the charge or as a result of operating trouble.

Consequently the unit has to be stopped every 3 to 6 months at the minimum to replace the first catalytic beds which are deactivated or clogged. This operation may take up to 3 weeks, with a corresponding reduction in the operating factor of the unit.

b) FLUIDIZED BED OR BOILING BED METHODS

Attempts have been made to deal with these disadvantages of fixed bed arrangements in different ways.

Figure 2:
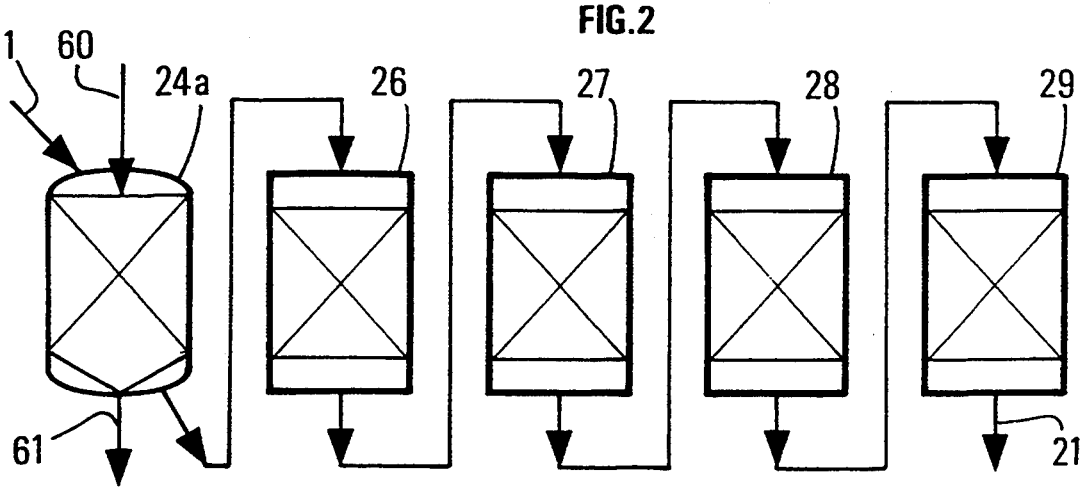

Thus one idea has been to install one or more 24-A fluidized bed reactors at the head of the HDM stage (see e.g. FIG. 2) (Patents U.S. Pat. No. 3,910,834 or GB-B-2124252A). The fluidized beds may operate co-currently (e.g. SHELL's HYCON process) or counter-currently (e.g. HYVAHL-M process). In this way fixed bed reactors are protected, while carrying out part of the demetallization and filtering the particles contained in the charge which may lead to clogging. In addition the quasi continuous replacement of catalyst in the fluidized bed reactor or reactors (with spent catalyst drawn off through pipe 61 and fresh catalyst introduced through pipe 60) avoids stopping the unit every 3 to 6 months.

The disadvantage of these fluidized bed technologies is finally that their performance and effectiveness are rather lower than those of fixed beds of the same size, that they cause wear on the circulating catalyst which may lead to blockage of downstream fixed beds, and that—particularly under the operating conditions used—the dangers of coking and thus of the formation of conglomerates of catalyst is far from negligible in these heavy charges, particularly if there is operating trouble; this may prevent circulation of the catalyst either in the reactor or in the lines for tapping spent catalyst, and finally lead to stoppage of the unit to clean the reactor and tapping lines.

Figure 3:
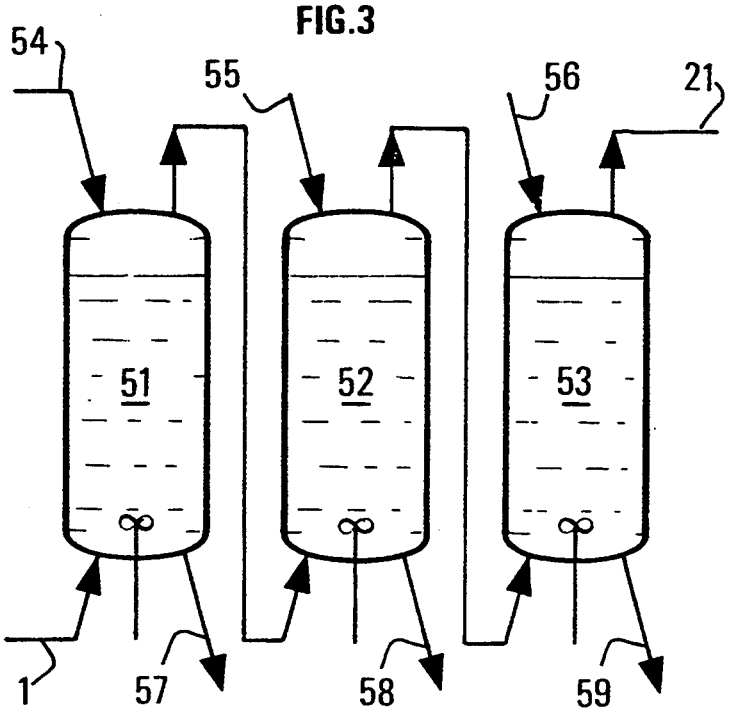

Another idea has been to use one or more boiling or "bubbling" beds arranged in series (the H-OIL process of the Hydrocarbon Research Institute or the LC-FINING process) of Ste Lymmus, U.S. Pat. No. 3,809,644. The carrying out of this technology has now been mastered and, particularly to a certain degree, the formation of aggregates due to coking does no harm since the grains of catalyst are always in motion. The catalyst is replaced quasi continuously without stopping the unit. On the other hand, the movement of catalyst causes serious wear, which makes it impossible to have any fixed bed reactor downstream of the boiling bed. Above all, the mixing of fresh and spent catalyst and the mixing of effluents with charge make the performance substantially worse than that of the fixed bed (quality of products), and make the catalyst ineffective (high catalyst consumption). FIG. 3 illustrates 3 reactors 51, 52, 53 in series, the arrival of fresh charge through the pipe 1 at the bottom of the first reactor 51 through which the charge passes, the discharge of effluent drawn off at the top of the last reactor 53 through which the charge passes, and the respective catalyst inlets 54, 55 and 56 and outlets 57, 58 and 59 in the 3 reactors in the figure.

c) EXISTING IMPROVEMENTS IN FIXED BED METHODS

Figure 4:
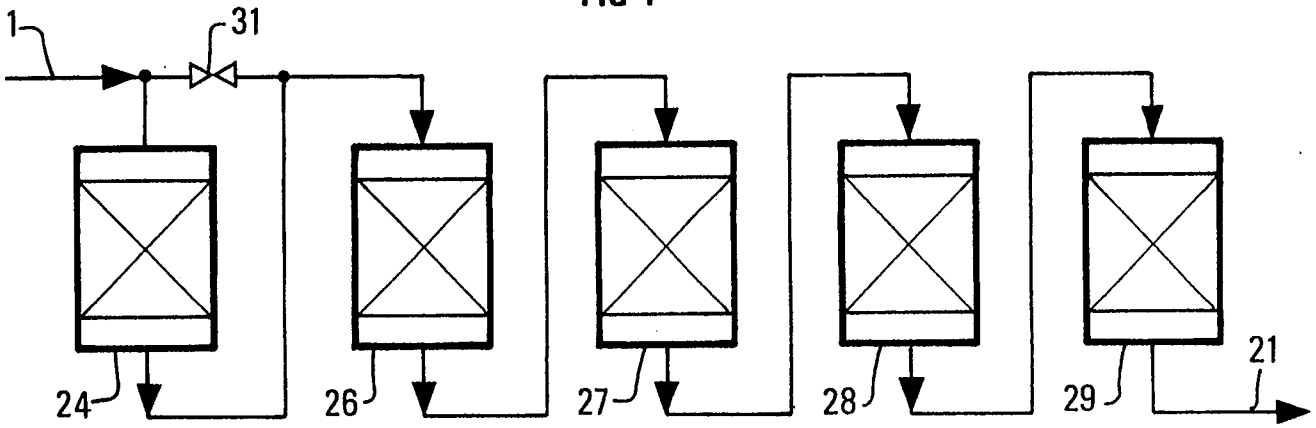

In order to preserve the excellent performance of fixed beds while maintaining an acceptable operating factor, a fixed bed protective reactor (reacteur de garde) (space velocity VVH=2 to 4) has been added before the HDM reactors U.S. Pat. Nos. 4,118,310 and 3,968,026). The protective reactor 24 can most frequently be short-circuited, particularly by using a valve 31 (see FIG. 4). This gives the main reactors temporary protection from clogging. When the protective reactor is clogged it is short-circuited, but the next main reactor (26) may then become clogged in turn and lead to stoppage of the unit. In addition the small size of the protective reactor (24) does not produce good demetallisation of the charge, so the main HDM reactors (reactors 26 and 27) are ill-protected from metal deposits in the case of charges rich in metals (over 150 to 200 ppm). There is consequent accelerated deactivation of the reactors, leading to over-rapid stoppages of the unit, and hence the operating factors are still inadequate.

SUMMARY OF THE INVENTION

In the present invention it has finally been discovered that, in order to associate the high performance of the fixed bed with a high operating factor for treating charges with a high metal content (100 to 400 ppm but preferably 100 to 300 ppm) an excellent method consists of:

using a fixed bed arrangement comprising an HDM stage then an HDS stage, the HDM stage being made up of one or more fixed bed HDM zones, preceded by two protective HDM zones, also fixed bed but arranged in parallel so that they can be used alternately; a single protective zone being in operation and gradually becoming charged with metals, coke, sediments and various other impurities, while the other protective zone is disconnected from the unit and standing by, filled with fresh HDM catalyst;

exchanging the protective zones when the first is completely saturated with metals and various impurities, that is to say, putting the protective zone containing the fresh catalyst into operation while disconnecting the protective zone previously in operation, containing the spent catalyst saturated with metals and various impurities;

preferably using a special processing section enabling the protective zones to be exchanged while in operation, that is to say, without stopping the unit: firstly a system operating at moderate pressure (from 10 to 50 bars but preferably from 15 to 25 bars) enables the following operations to be carried out on the disconnected protective reactor: washing, stripping, cooling before the spent catalyst is discharged, then heating and sulturization when the fresh catalyst has been charged; next another pressurizing/depressurizing, valve/tap system with the appropriate technology effectively enables the protective zones to be exchanged without stopping the unit, that is to say, without affecting the operating factor, since all the operations of washing, stripping, discharging the spent catalyst, recharging the fresh catalyst, heating and sulphurization take place in the disconnected protective reactor or zone;

preferably also using the following space velocities per hour (VVH):

| | VVH (h-1) | Preferably |
|---|---|---|
| Total HDM stage: (including protective reactor) | 0.2–0.5 | 0.3–0.4 |
| Total HDS stage: | 0.2–0.5 | 0.3–0.4 |
| Globally (HDM + HDS): | 0.10–0.25 | 0.15–0.20 |

The preferred feature of the invention here comprises operating the working protective zone or reactor at a relatively low VVH (0.5 to 1.5 and preferably 0.8 to 1.2), contrary to other methods using smaller protective reactors, particularly that described in U.S. Pat. No. 3,968,026 where the protective reactors used (a) are smaller and (b) operate simultaneously and not alternately. The VVH value (0.8 to 1.2) has been selected to obtain the maximum HDM while controlling the reaction temperature (limiting exothermicity).

It has been found that the following results can be obtained by using the appropriate HDM/HDS catalysts, preferably those produced by Patents EP-B-113297 and EP-B-113284, and the features of the invention described above:

Over 50% of HDM in the charge in the protective zone or reactor (more specifically from 50 to 60% of HDM) owing to the low VVH selected and the effectiveness of the HDM catalyst, in contrast with prior art methods which did not allow more than about 35% of HDM in the protective reactor. Moreover owing to the high metal retaining capacity of the catalyst (over 60% of metals deposited relative to the weight of new catalyst), each protective zone or reactor can function from 2 to 6 months and more particularly from 3 to 4 months before the protective zones or reactors have to be exchanged, that is to say, before the operating protective zone or reactor containing the spent catalyst is disconnected and replaced by the other protective reactor containing fresh catalyst.

An operating cycle of at least 11 months for the main HDM and HDS reactors, owing to the excellent protection which the protective reactor gives them against metals (over 50% of HDM) and against problems of clogging with sediments, coke and other impurities.

At the end of the cycle of at least 11 months, obtained even with charges rich in metals (100 to 400 ppm, preferably 150 to 300 ppm), the unit has to be stopped for total replacement of the catalyst contained in the main reactors. Since this operation can conveniently be carried out in less than a month, it is found that by operating in accordance with the invention an operating factor of at least 0.91 (i.e. 11 months out of 12), is obtained; this is substantially better than the working factor for prior art fixed bed processes and at least equivalent to processes using one or more fluidized beds. In addition the presence of a standby protective reactor full of fresh catalyst and always ready to be connected avoids trouble which may drastically affect the working protective reactor (e.g. coking as a result of trouble with reactor control, or clogging as a result of accidental entrainment of salts or sediments by the charge) and thus helps to maintain a high operating factor.

Maintenance of a high refining and conversion performance right through the cycle while the products are kept stable:

over 90% global HDS;

from 90 to 95% global HDM.

Figure 5:
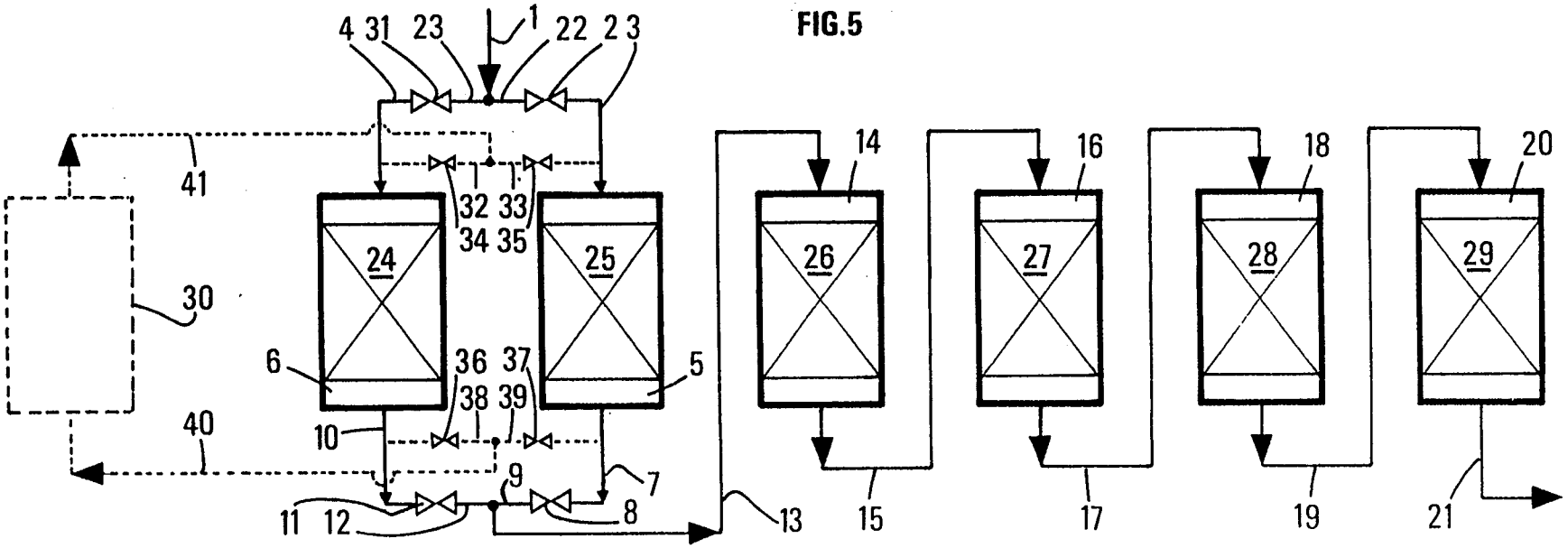
FIG. 5 is a flowsheet illustrating a preferred comprehensive embodiment of the present invention.

FIG. 5 explains the invention briefly by way of illustration. The charge is passed through line 1 and line 22 to a valve 2 and pipe 3 and into a protective hydrodemetallization reactor 5 with a fixed bed 25 of catalyst. The effluent is discharged through a pipe 27, valve 8 and lines 9 and 13 to a main hydrodemetallization reactor 14 containing a fixed bed 26 of catalyst. The effluent from the reactor 14 is drawn off through a pipe 15 then passed into another hydrodemetallization reactor 16 where it travels through a fixed bed 27 of catalyst. The effluent from the reactor 16 is drawn off through a pipe 17 and enters the first hydrodesulphurization reactor 18 where it travels through a fixed bed 28 of catalyst. The effluent from the first hydrodesulphurization reactor 18 goes through a pipe 19 to the second hydrodesulphurization reactor 20 where it passes through a fixed bed 29 of catalyst. The final effluent is drawn off through a pipe 21.

When the working protective reactor 5 is no longer operating, the charge in the pipe 1 is then passed through a pipe 23, valve 31 and pipe 4 into the other protective hydrodemetallization reactor 6 containing a fixed bed 24 of catalyst. The effluent from the protective reactor 6 passes through a pipe 10, valve 11 and pipes 12 and 13 to the hydrodemetallization reactor 14, and the effluent from the reactor 6 then continues to circulate as explained above.

A section 30 is equipped with appropriate circulating, heating, cooling and separating means which operate independently of the reaction section. By means of pipes 41, 32 and 33, valves 34 and 35, valves 36 and 37 and pipes 38, 39 and 40, the section 30 makes it possible to carry out the operations for preparing the fresh catalyst contained in the protective reactor 6 just before it is connected, with the unit working, to replace the protective reactor 5, namely: preheating the protective reactor 6, sulphurizing the catalyst 24 and putting it under the pressure and temperature conditions required for the exchange. When the operation of exchanging the protective reactors 5 and 6 is carried out by means of the set of the valves 2, 31, 8 and 11, the section 30 this time makes it possible to carry out the operations of processing the spent catalyst contained in the protective reactor 5 immediately after it has been disconnected from the reaction section, namely: washing and stripping the spent catalyst 25 under the required conditions, then cooling it before proceeding to the operations of discharging the spent catalyst and replacing it with fresh catalyst.

The catalysts in the protective reactors are preferably the same as those in the hydrodemetallization reactors 14 and 16.

It is also preferable for the catalysts to be those described in Patent EP-B-98764. They contain a carrier and from 0.1 to 30% by weight, counted in metallic oxides, of at least one metal or metal compound from at least one of groups V, VI or VIII of the Periodic Table. These are in the form of a plurality of juxtaposed conglomerates, each formed by a plurality of acicular tips, the tips of each conglomerate being directed generally radially of one another and radially of the center of the conglomerate.

This invention more particularly concerns the treatment of heavy petroleums or heavy petroleum fractions with a high asphaltene content, for the purpose of converting them to less heavy fractions which can more easily be transported or treated by normal refining processes. Coal hydrogenation oils may also be treated.

More particularly, the invention solves the problem of converting a heavy, viscous oil which is immobile (non transportable) and rich in metal, sulphur and asphaltenes and which contains over 50% of constituents with a normal boiling point above 520° C., to a stable, easily moving (transportable) hydrocarbon product with a low content of metals, sulphur and asphaltenes and only a reduced content, e.g. less than 20% by weight, of constituents with a normal boiling point above 520° C.

In an improvement of the present invention the charge is mixed with hydrogen and subjected to hydroviscoreduction conditions before being passed to the protective reactors.

EXAMPLE 1

As an example a heavy fraction of the residue type, as in Example 1 of European Patent EP-B-113297, is treated using catalyst A with a "sea urchin" structure in the HDM reactors and catalyst B in the HDS reactors.

To compare the advantages provided by the invention, treatment of the charge will be described using the following two types of method:

Method I: traditional fixed bed method comprising a first HDM stage followed by a second HDS stage;

Method II: the method according to the invention, that is to say, also including a fixed bed HDM stage followed by a fixed bed HDS stage, but with the HDM stage taking place in at least one fixed bed HDM reactor, itself preceded by two protective HDM reactors arranged in parallel and used alternately, with one reactor operating and the other standing by, disconnected from the unit.

When the catalyst in the working protective reactor has lost its activity and/or is sufficiently blocked with coke or sediments to be no longer usable, the two protective reactors are exchanged. The standby reactor is connected to the unit while the other, previously working reactor, is disconnected from it; the exchange takes place without stopping the unit, that is to say, without affecting its operating factor. Also according to the invention, a relatively low VVH is selected in each of the protective reactors, so as to give the other reactors optimum protection from metals and thus maximize their operating cycles:

VVH protective reactors—0.6 to 1.5 and preferably 0.8 to 1.2

Global VVH of all reactors (HDM+HDS): 0.10 to 0.25 and preferably 0.15 to 0.20.

The low VVH of the protective reactors results in a volume substantially of the same order of magnitude as the other main HDM or HDS reactors; this is in contrast with other fixed bed methods using protective reactors of smaller volume.

Charge Treated

| "SAFANIYA" vacuum residue | |
|---|---|
| TBP cut: | 540+° C. |
| Density at 15° C.: | 1.035 |
| Sulphur: | 5.28% by weight |
| Conradson carbon: | 25% by weight |
| C7 asphaltenes: | 11.9% by weight |
| Metals (Ni + V): | 214 ppm |

Operating Conditions are fixed so as to obtain maximum conversion compatible with the stability of the products, and a mean HDM of 95%.

| Comparison of Methods (at equivalent global VVH): | Method I | Method II |
|---|---|---|
| Global mean HDS | 90% | 90% |
| Global mean HDM | 95% | 95% |
| Mean comversion (to 540−) | 40% | 40% |
| VVH protective reactor | — | 1.0(*) |
| HDM protective reactor | — | 50% |
| Continuous operating cycle | 5 months | 11 months |
| Stoppage to replace catalyst | 1 month max. | 1 month max. |
| Operating factor | 0.83 | 0.92 |

((*) protective reactor exchanged every 4 months)

Thus it will be seen that in Method II according to the invention longer operating cycles and a higher operating factor are obtained than if a traditional fixed bed method is used; this advantage is all the more marked when charges richer in metals are treated. Beyond a metal content of 250 ppm, for example, it is not even realistic to envisage traditional fixed bed treatment, whereas a method according to the invention will enable long operating cycles and high operating factors to be maintained.

EXAMPLE 2

We have also studied treatment according to the invention of existing charges (petroleum residues) where the metal content ranges from 130 ppm to 328 ppm and where there are various difficulties in the treatment. The results obtained are given in the table below:

| Charge, case number: | 1 | 2 | 3 | 4 |
|---|---|---|---|---|
| Sulphur content (% by weight) | 4.3 | 5.28 | 3.55 | 7.75 |
| Metal content (ppm) | 130 | 214 | 269 | 328 |
| Global HDS (% by weight) | 90 | 90 | 90 | 90 |
| Global HDM (% by weight) | 95 | 95 | 95 | 95 |
| VVH protective reactor | 1.2 | 1.0 | 1.0 | 0.8 |
| HDM protective reactor (% by weight) | 50 | 50 | 55 | 65 |
| Continuous operating cycle (months) | 11 | 11 | 11 | 11 |
| Stoppage to replace catalyst (months, max.) | 1 | 1 | 1 | 1 |
| (Protective reactor cycle in months) | (6) | (4) | (3) | (3) |

Charges:
Case 1: Residue ARABIAN LIGHT
2: Residue SAFANIYAH
3: Residue IRANIAN LIGHT
4: Residue ROSPO MARE

I claim:

1. In a method of hydrotreatment in at least two stages, of a heavy hydrocarbon fraction containing asphaltenes, sulfur impurities and metallic impurities, wherein:

(a) in at least one first hydrodemetallization stage, the hydrocarbon charge and hydrogen are passed over a hydrodemetallization catalyst in a hydrodemetallization zone or zones, and (b) in at least one subsequent hydrodesulfurization stage, the product of stage (a) and hydrogen are passed over a hydrodesulfurization catalyst, the improvement wherein the hydrodemetallization zone or zones is or are preceded by two protective zones in parallel, each containing a fixed bed of a hydrodemetallization catalyst, the two protective zones operating only alternately, one off-stream and one on-stream, and wherein the volume of each protective zone has sufficient demetallization capacity to provide sufficient time to permit the off-stream protective zone to be treated and placed on-stream, so as to permit the exchanging of the protective zones without stopping the unit or decreasing the capacity of the unit.

2. The method of claim 1, wherein each of said protective zones has substantially the same volume as a hydrodemetallization zone.

3. The method of claim 1, wherein the volume of feed per volume of catalyst per hour in the working protective zone is from 0.5 to 1.5.

4. The method of claim 3, wherein the volume of feed per volume of catalyst per hour is from 0.8 to 1.2.

5. The method of claim 1, wherein the catalyst used in the protective zones contains a carrier and from 0.1 to 30% by weight, counted in metallic oxides, of at least one metal or metal compound from at least one of groups V, VI or VIII of the Periodic Table, in the form of a plurality of juxtaposed conglomerates each formed by a plurality of acicular tips, the tips of each conglomerate being directed generally radially of one another and radially of the center of the conglomerate.

6. The method of claim 1, wherein a processing section is associated with the protective zones and enables them to be exchanged while in operation, without stopping the unit, said section being regulated so as to process the catalyst contained in the off-stream protective zone at a pressure of 10 to 50 bars.

7. The method of claim 6, wherein said pressure is from 15 to 25 bars.

8. The method of claim 1, for treating a charge comprising a heavy oil or a heavy oil fraction containing asphaltenes, wherein the charge is first subjected to hydroviscoreduction conditions, mixed with hydrogen, before being passed into the protective zones.

9. The method of claim 1, wherein the charge has a metal content of 100–400 ppm.

10. The method of claim 9, wherein the charge has a metal content of more than 250 ppm.

11. The method of claim 6, wherein the charge has a metal content of 100–400 ppm.

12. The method of claim 11, wherein the charge has a metal content of more than 250 ppm.

13. A method according to claim 1, comprising an upstream hydrodemetallization and at least one downstream hydrodemetallization zone operating continuously in series, wherein each hydrodemetallization zone is conducted in a separate reactor, the upstream zone being preceded by said two protective zones conducted in separate reactors.

14. The method of claim 13, wherein the charge has a metal content of 100–400 ppm.

15. The method of claim 13, wherein the charge has a metal content of more than 250 ppm.

16. A process according to claim 1, wherein the hydrodemetallization stage operates at a continuous 100% capacity until the hydrodesulfurization stage is shut down.

* * * * *